US008436731B2

(12) United States Patent
Davis et al.

(10) Patent No.: US 8,436,731 B2
(45) Date of Patent: May 7, 2013

(54) PORTABLE SECURITY CONTAINER WITH ROTATION DETECTION SYSTEM

(76) Inventors: Barrie William Davis, South Brisbane (AU); Benjamin John Davis, Alderley (AU); Mathew Kai Davis, Fortitude Valley (AU)

( * ) Notice: Subject to any disclaimer, the term of this patent is extended or adjusted under 35 U.S.C. 154(b) by 0 days.

(21) Appl. No.: 12/931,782

(22) Filed: Feb. 9, 2011

(65) Prior Publication Data

US 2011/0133933 A1 Jun. 9, 2011

Related U.S. Application Data

(63) Continuation-in-part of application No. 12/537,825, filed on Aug. 7, 2009, and a continuation-in-part of application No. 12/536,902, filed on Aug. 6, 2009.

(60) Provisional application No. 61/337,762, filed on Feb. 9, 2010, provisional application No. 61/087,175, filed on Aug. 8, 2008.

(51) Int. Cl.
*G08B 21/00* (2006.01)
*G08B 13/14* (2006.01)

(52) U.S. Cl.
USPC ..... 340/540; 340/571; 340/669; 340/689; 340/568.1

(58) Field of Classification Search ..... 340/540, 340/571
See application file for complete search history.

(56) References Cited

U.S. PATENT DOCUMENTS

| | | | | |
|---|---|---|---|---|
| 4,479,114 | A * | 10/1984 | Yamamoto | 340/566 |
| 5,153,561 | A | 10/1992 | Johnson | |
| 5,493,274 | A | 2/1996 | Long | |
| 5,574,429 | A | 11/1996 | Streeter | |
| 5,757,270 | A | 5/1998 | Mori | |
| 5,850,624 | A * | 12/1998 | Gard et al. | 702/92 |
| 6,133,830 | A | 10/2000 | D'Angelo et al. | |
| 6,133,842 | A | 10/2000 | Gariepy | |
| 6,970,095 | B1 | 11/2005 | Lee et al. | |
| 6,992,585 | B2 | 1/2006 | Saleh et al. | |
| 7,305,858 | B1 | 12/2007 | Wu | |
| 2002/0145531 | A1 * | 10/2002 | Delaney | 340/689 |
| 2003/0071739 | A1 * | 4/2003 | Addy et al. | 340/686.1 |
| 2005/0040229 | A1 | 2/2005 | Andrews et al. | |
| 2007/0103278 | A1 | 5/2007 | Kawata | |
| 2007/0126576 | A1 | 6/2007 | Script et al. | |
| 2007/0169364 | A1 | 7/2007 | Townsend et al. | |
| 2007/0176784 | A1 | 8/2007 | Fautin et al. | |
| 2007/0188321 | A1 | 8/2007 | Stenlund | |
| 2007/0214886 | A1 * | 9/2007 | Sheynblat | 73/509 |
| 2008/0036595 | A1 | 2/2008 | Hollstien et al. | |
| 2008/0254822 | A1 * | 10/2008 | Tilley | 455/550.1 |
| 2009/0077675 | A1 | 3/2009 | Cabouli | |

(Continued)

OTHER PUBLICATIONS

Acar, C. and Shkel, A., "MEMS Vibratory Gyroscopes, Structural Approaches to Improve Robustness," Springer Science+Business, 2010.

*Primary Examiner* — George A Bugg
*Assistant Examiner* — Jack K Wang
(74) *Attorney, Agent, or Firm* — Martin & Ferraro, LLP

(57) ABSTRACT

A device and method for protecting personal property. The device includes an angular rotation detection system utilizing a gyroscope and an alarm adapted to signal when the device has tilted or rotated beyond a predetermined position from a reference position.

21 Claims, 3 Drawing Sheets

U.S. PATENT DOCUMENTS

2009/0121869 A1 5/2009 Graichen
2010/0019902 A1 1/2010 Mullet
2010/0032332 A1 2/2010 Davis et al.
2010/0033329 A1 2/2010 Davis et al.

* cited by examiner

PORTABLE SECURITY CONTAINER WITH ROTATION DETECTION SYSTEM

CROSS-REFERENCE TO RELATED APPLICATIONS

This application claims the benefit of U.S. Provisional Application No. 61/337,762, filed Feb. 9, 2010, entitled "Portable Security Container With Rotation Detection System;" and is a Continuation-in-Part of U.S. application Ser. No. 12/537,825, filed Aug. 7, 2009, entitled "Portable Security Container With Tilt And Movement Detection System," which claims the benefit of U.S. Provisional Application No. 61/087,175, filed Aug. 8, 2008, entitled "Portable Security Container With Movement Detection System," all of which are incorporated by reference herein.

This application is also a Continuation-in-Part of U.S. application Ser. No. 12/536,902, filed Aug. 6, 2009, entitled "Portable Security Container With Movement Detection System," which claims the benefit of U.S. Provisional Application No. 61/087,175, filed Aug. 8, 2008, entitled "Portable Security Container With Movement Detection System," all of which are incorporated by reference herein.

FIELD OF THE INVENTION

The present invention relates to improvements in devices designed to protect personal portable property such as mobile phones, music players, keys, wallets, purses, laptop computers, guns, GPS systems, money, documents and other similar personal items which can be quickly and easily stolen.

BACKGROUND OF THE INVENTION

In recent times the value of personal belongings carried by most people in their day to day business has increased significantly. As well as the replacement cost of devices such as mobile phones, music players, there is also the additional cost of losing or having to replace phone numbers, photographs, music, which are held in the portable devices. Most people understand that having one of these devices stolen or misplaced will be a significant inconvenience in addition to the financial cost of buying a replacement. In the case of a laptop computer, smart phone or other device capable of storing personal data, the replacement cost of the device may be insignificant compared to the value of the information saved therein.

In addition to the personal electronic devices, loss of other more fundamental items people carry on their person such as house keys, car keys, wallets, credit cards, passports, can have a significant impact if they are stolen.

One way to protect these personal items is to place them in a secure environment. However on many occasions this is not possible. At the beach, gymnasium, living in a dormitory, or even just leaving a work space for a short time, exposes personal property to theft. Lockers, desk drawers, cupboards etc. provide some protection, but in most cases can be easily forced open or defeated in some other manner. When this happens, there is no alarm event to alert others the theft is occurring, which is why the loss of personal property in these situations is so prevalent.

Recent statistics indicate that of the total university dormitory population of the USA, about 25% will experience one personal theft a year. When extrapolated across the country to include country clubs, sports facilities, factory/office locker rooms, office desks, the level of personal theft is high and increasing. This is especially so for personal electronic devices which are now so wide spread that it is almost impossible to identify a specific unit as one's own once it has been stolen.

There are any number of devices which will detect the occurrence of movement and provide an alarm when they are moved. Most, if not all of these devices rely on the detection of motion in some way or another. They commonly rely on the motion of an attached object to cause a mechanical motion of part of the device which is then detected and an alert provided. Examples are mercury switch relays, moving pin mechanisms and ball race devices where the movement of an object causes a secondary motion within the detection device, which causes an alarm event.

A problem in detecting the motion of an object as the necessary event to cause an alarm condition is that motion in itself is not necessarily a sufficient condition for an alarm event. For example, if an object is accidentally knocked, it will experience motion even though it may not be subject to continual movement which involves the change in the position or location of something. If the movement of an object is to be the cause for an alarm event, then this condition may be accidentally satisfied and result in a false alarm if only the occurrence of motion is recognized.

SUMMARY

In one preferred aspect, the present invention is a portable light weight container which can be locked using a combination lock to secure any items placed inside. To prevent the locked container from being moved to a location where it could be forced open without attracting attention, a rotation detection system is incorporated into the lid of the container. An audible alarm is also provided so that when the container is rotated around one or more of its axis the alarm is activated.

In another preferred aspect, the present invention may be adapted to determine if it is being moved and/or rotated and may be adapted to determine if the movement and/or rotation is a hostile event, in which case an audible alarm is sounded.

The present invention preferably provides protection against the theft of personal valuable items in several ways which work in unison to provide a comprehensive theft prevention method.

DETAILED DESCRIPTION OF THE DRAWINGS

Alternative embodiments of the invention will be apparent to those skilled in the art from consideration of the specification and practice of the invention disclosed herein. It is intended that the specification and examples be considered as exemplary only, with a true scope and spirit of the invention being indicated by the claims which follow.

Figure 1:
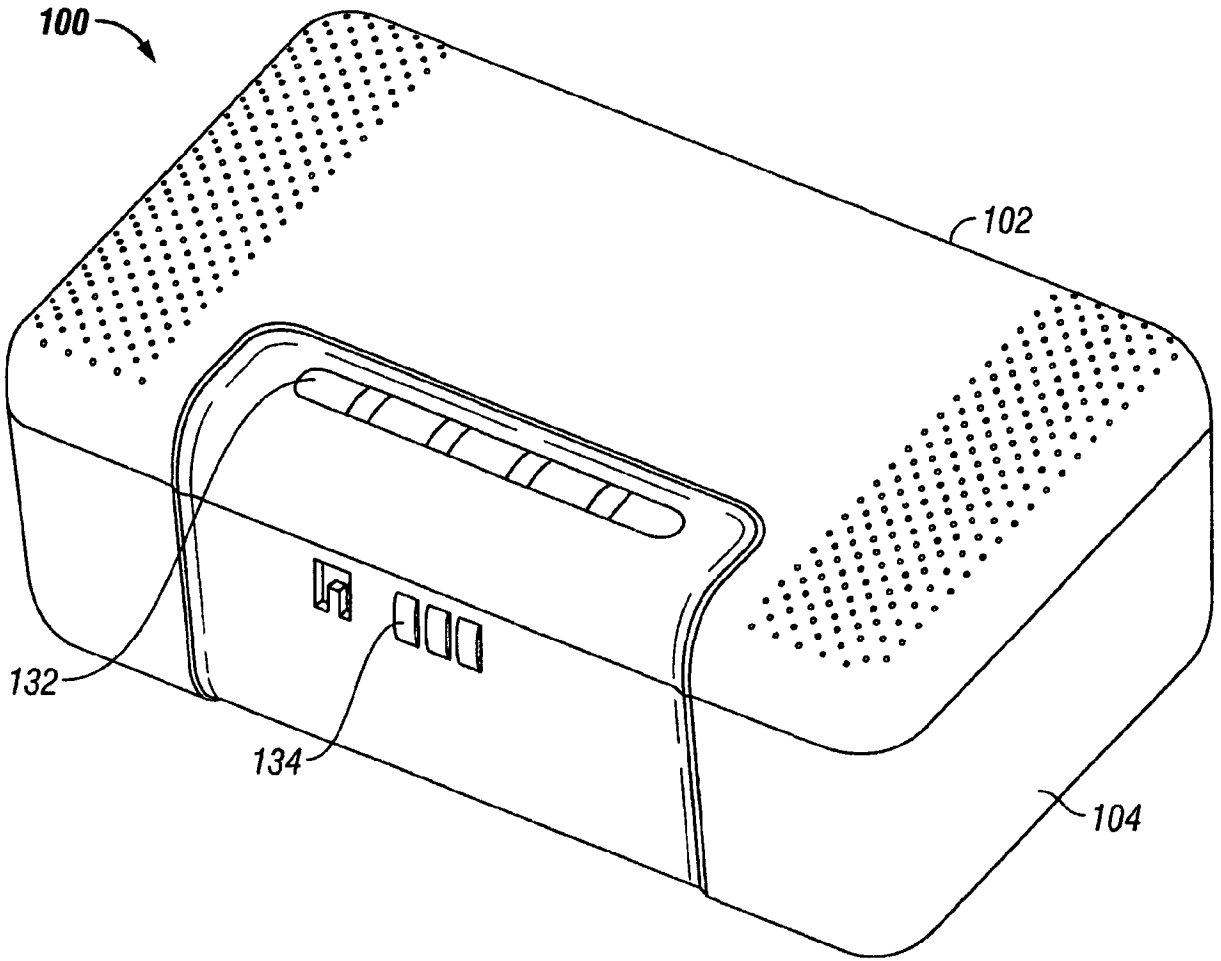
FIG. 1 is a perspective view of a security container with rotation detection system in accordance with a preferred embodiment of the present invention.
Figure 2:
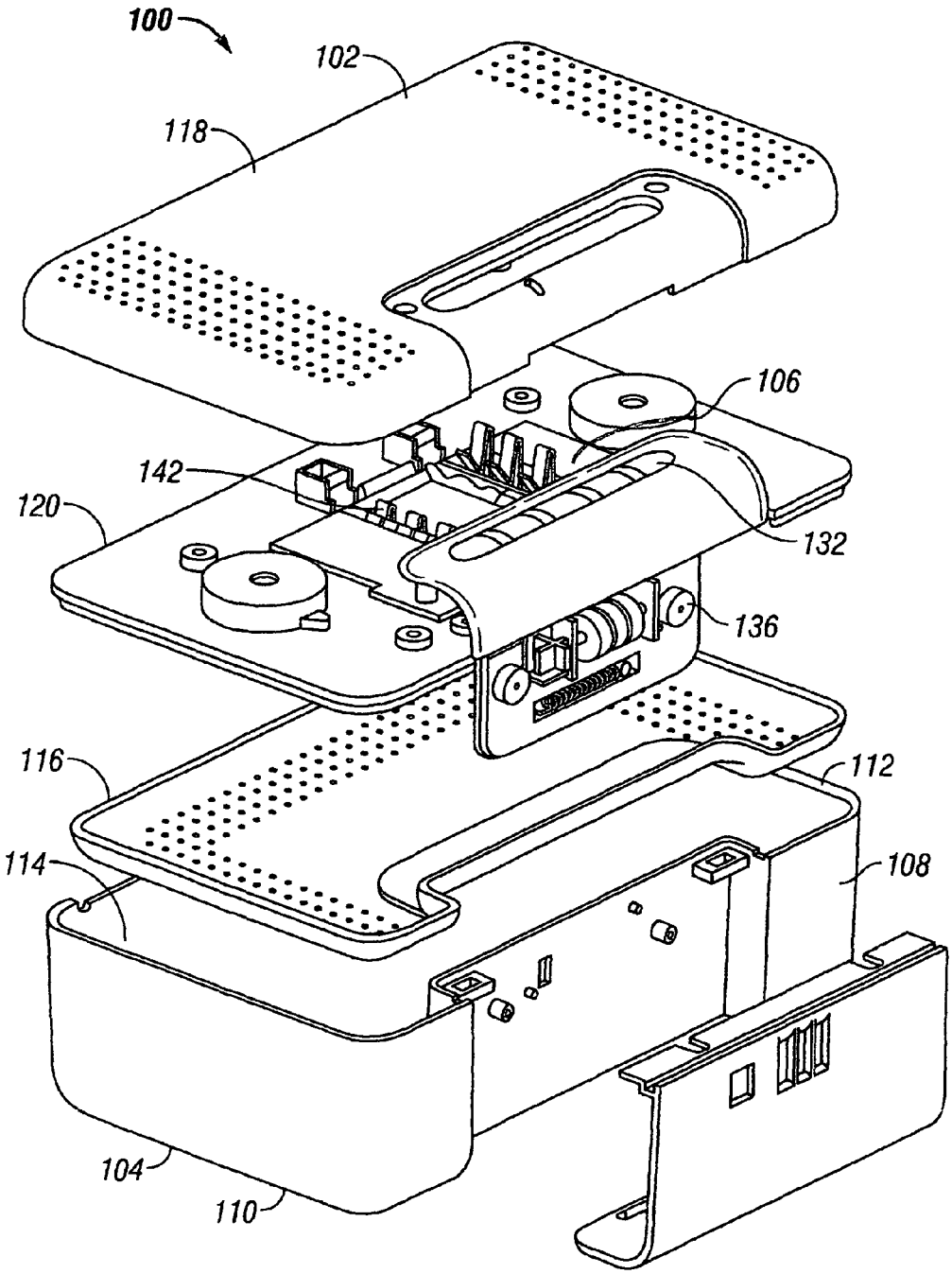
FIG. 2 is an exploded view of the container of FIG. 1.
Figure 3:
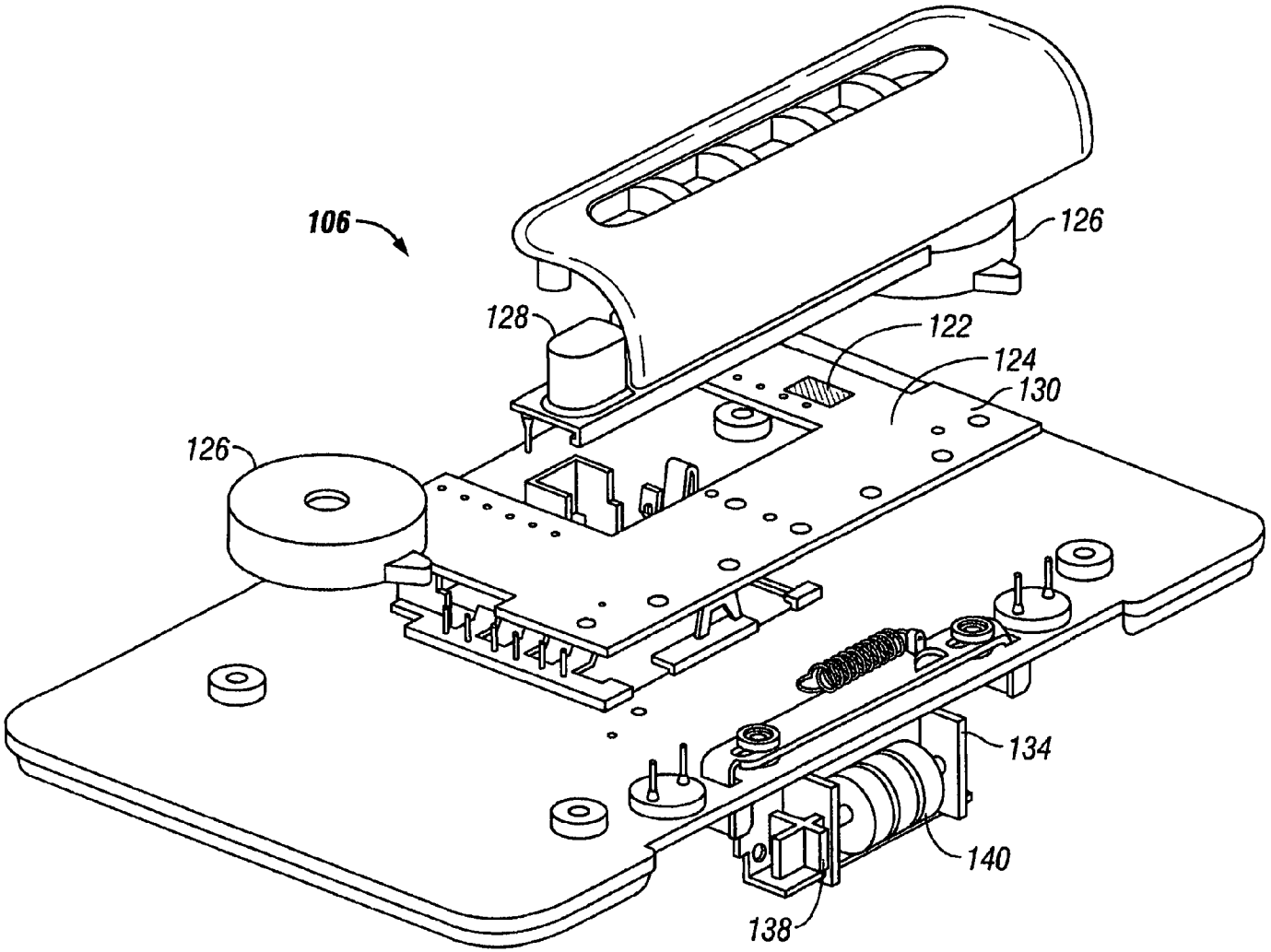
FIG. 3 is an enlarged view of the rotation detection system of the container of FIG. 1.

FIGS. 1 to 3 show a preferred embodiment of a security container 100 having a lid 102, a base 104 and a rotation detection system 106. The preferred elements of container 100 and their interrelationship are described below.

Referring to FIGS. 1 and 2, container 100 includes a front 108, sides 110, 112 and an interior 114. Interior 114 preferably is sized and configured to receive a removable bottom tray 116. As shown in FIG. 2, lid 102 preferably includes a top cover 118 and a base cover 120 on which is at least a portion of rotation detection system 106. Lid 102 may be hinged or detachably attached to base 104.

As shown in FIGS. 2 and 3, rotation detection system 106 preferably includes an electronics assembly having a rotation detector 122, a controller 124, an alarm 126 and an arming mechanism 128. Each of these components is discussed in further detail below.

Referring to FIG. 3, rotation detector 122 is preferably formed as a gyroscope. The gyroscope is preferably a MEMS three-axis gyroscope which measures the angular movement of its own motion around its three geometric axes (X, Y and Z). In the plane axis, which is along the gyroscope's surface, rotation around the X-axis is normally called pitch, and rotation around the Y-axis is normally called roll. Angular rotation around the Z-axis, which is perpendicular to the gyroscopes plane surface, is normally called yaw. The gyroscope preferably measures the angular rotation around each axis simultaneously and provides outputs in either analog or digital format representing the angular rotation in degrees per second. By using appropriate measuring, conversion and scaling techniques, which would be understood by those of ordinary skill in the art, the actual angular rotation of the MEMS gyroscope in three dimensional space can be determined. A MEMS gyroscope is explained in more detail in "MEMS Vibratory Gyroscopes," Cenk Acar and Andrei Shkel, (©2009, Springer Science+Business, LLC) (ISBN 978-0-387-09535-6), the contents of which is incorporated by reference herein.

When the gyroscope is at rest and no angular rotation is occurring, the outputs which correspond to the rotation around the X, Y and Z-axes are at their Zero Rate level. By determining that the three axes outputs are at the Zero Rate level, it can be determined that the three-axis MEMS gyroscope is not being subjected to any rotational forces, i.e., is at rest. However, while it is possible to move a three-axis gyroscope without subjecting it to any rotation around any of its three axes, this is extremely unlikely in a situation where a theft is taking place. In such a circumstance, the gyroscope is subjected to acceleration as it is moved. However, in being moved, it would also be subjected to angular rotation. It is this angular rotation which is measured to preferably determine whether a hostile event is occurring.

Although the instantaneous values of a MEMS three-axis gyroscope's measurement of its pitch, roll and yaw can be provided in a digital format, the most common form at the present time is by three individual analog voltages, each representing the angular rotation around one of the axes of the gyroscope. In the following description it will be assumed the gyroscope is of the analog type with three analog outputs. However, one or more outputs may be in the digital form if desired. The Sensitivity of the gyroscope is preferably scaled in millivolts per degree per second (mV/dps), so by measuring the value of each output voltage relative to the Zero Rate level and applying the appropriate conversion, the rate of the angular rotation around each axis can be determined in degree per second. The Sensitivity and Zero Rate levels of the gyroscope are specified by the manufacturer of the gyroscope as one of the operating parameters of the device.

The system may also include an accelerometer if desired. The accelerometer would preferably be a MEMS three-axis, low gravity analog or digital output acceleration sensor which provides its own instantaneous acceleration relative to the acceleration of the Earth's gravity of 1 g, the acceleration when the accelerometer is at rest. The outputs of the accelerometer are preferably three values in either analog or digital format, one each for the individual acceleration relative to the Earth's gravity in the X-axis, Y-axis and Z-axis coordinates of three dimensional space. The system may also include a magnetometer if desired. Incorporation of a magnetometer allows the direction and magnitude of the Earth's magnetic field to be determined, which can be used to enhance the accuracy when determining the position of the container.

Referring to FIG. 3, controller 124 is preferably formed as a single chip microcontroller, although a multiple chip microcontroller can equally be used if desired. The microcontroller receives angular rotation information in analog format from gyroscope via the X-axis, Y-axis and Z-axis signal outputs of the gyroscope. Because the value of angular rotation is preferably represented as three electrical analog voltages, it is usually necessary to convert the analog signal value to a digital value to allow the situational information to be processed by the mathematical algorithms executed by microcontroller. Preferably the microcontroller incorporates an Analog to Digital (A/D) conversion functional unit, although an external A/D unit could also be used if desired. It is envisaged that the A/D unit may form a portion of the gyroscope if desired. It will be appreciated that the gyroscope may provide values in digital format and that the microcontroller may have a digital chip to eliminate any need for an A/D conversion. Controller 124 preferably includes a real time clock, described in more detail below.

In a preferred embodiment, the present invention uses a MEMS three-axis gyroscope to measure the pitch, roll and yaw caused by the motion of the invention. The ability to be able to measure changes in rotation around all three axes simultaneously significantly increases the ability to determine a hostile event over methods that only measure rotation around one or two axes.

Rotation around a single axis will result in a rotation vector for that axis only. If the rotation is very slow, which is the case when the motion around the axis is very slow, it may be less than the resolution of the gyroscope. However, rotation around two axes will result in two rotation vectors and rotation around all three axes will result in corresponding three rotation vectors and provide additional sensitivity, which enhances the determination of motion.

When the system is armed and stationary, there is no angular rotation associated with movement of the object. Unlike rotation along a single axis of the gyroscope, if the orientation or tilt of the object being monitored changes, it will result in the change in the angular rotation on at least two axes of a three-axis gyroscope. As soon as the change in the angle of tilt is such that the resolution of the gyroscope is exceeded, the angular rotation readings will change on at least two axes, which can be determined as a hostile event.

When a hostile event occurs, it is most usually due to the object that is being monitored being picked up and carried away. In this event, the combined effects of rotation due to orientation and motion will occur and it is a preferred ability of the present invention to be able to measure and interpret this complex effect that increases its sensitivity in determining the occurrence of a hostile event.

The microcontroller preferably has a non-volatile, read-only memory that provides the program storage for the mathematical, logical and decision-making algorithms. The microcontroller preferably further includes a read-write memory which may be volatile and provides temporary storage for the results of calculations. The microcontroller preferably also includes an interrupt system which may be used by the real time clock and an input means, described further below, to activate the rotation detection system if it is in a power down or sleep mode.

The real time clock is preferably an independent timing circuit which can be started and stopped by the microcontroller. It is preferably connected to the microcontroller's interrupt system and is used by microcontroller to provide a "wake up" signal when in a sleep mode. To conserve battery power, the microcontroller can activate the real time clock and then change to its sleep mode. At a predetermined time, the real time clock will activate the microcontroller's interrupt system and cause the microcontroller to "wake up" to monitor mode to check the status of the tilt and movement detection system.

A preferred embodiment of the invention has an alarm which is preferably an audible alarm, more preferably a piezo audio transducer unit which can provide in excess of 80 dB of audible sound from a physically small, low power device. Preferably, the alarm is sufficiently audible to be heard from outside the container at a radius greater than 5 m, more preferably greater than 10 m. The audible alarm may be used in conjunction with an LED indicator to provide audio and visual feedback to the user on the status of system during the entry of the security code and the arming and disarming operations, described further below. The piezo audio transducer is preferably driven by a switching H-bridge amplifier which provides an optimum 30 volts peak-peak signal from a 15 volt power supply derived from a primary 4.5 volt battery power system. It will be appreciated that the piezo audio transducer can also be driven from a transformer to provide the required voltage.

It will be appreciated that the real time clock can be incorporated into the microcontroller, but this method may consume additional battery power compared to the external real time clock method.

The arming mechanism 128 preferably includes a keypad 132 having preferably five keys as the interface between a user and the microcontroller. Keypad 132 is preferably used to: arm the system; disarm the system; and reset the system if a mistake is made when entering a user command.

| Keypad Layout | | | | |
|---|---|---|---|---|
| A | 1 | 2 | 3 | D |

As shown above, keypad 132 preferably includes five keys or buttons in one row. The keys are preferably annotated A (Arm), the numbers one (1), two (2), and three (3) and D (Disarm). The five keys are preferably used in conjunction with each other to: select a motion sensitivity program; enter the security code; arm the system which activates rotation detection; disarm the system which suspends rotation detection.

The preferred functions of the individual keys are: number keys 1, 2, and 3—used to enter a four to six number security code into the system; Alpha key A—the first and last character of an arm sequence; and Alpha key D—the first and last character of a disarm sequence. It will be appreciated that the keys may be differently configured if desired. For example, instead of "A" and "D" keys, symbols showing a padlock in the locked or unlocked position may be used as desired.

Keypad 132 preferably connects directly to the microcontroller interrupt system and pressing the arm or disarm key preferably causes the microcontroller to power up from sleep mode and bring the system into a monitor mode, its active mode of operation.

As shown in FIGS. 2 and 3, container 100 preferably includes a lock 134, which is preferably a combination lock. Lock 134 preferably includes a mounting boss and lock plate slide guide 136, a lock plate knob 138 and a combination element 140. The combination lock is preferably a three-rotor mechanism with each rotor preferably having ten positions, which provide an adequate number of unique settings to thwart most attempts to guess the correct combination. Other combinations of rotors and rotor positions can be used if required. Alternatively, a mechanical lock and key can be used instead of a combination lock.

Referring to FIG. 2, rotation detection system 106 is preferably powered by batteries insertable into battery clips 142. The piezo audio alarm provides its loudest audio output when it is driven by a 30 volt peak-peak signal while the rest of the electronics circuits require from 3 to 5 volts DC. Primary power is preferably provided by three AAA batteries, preferably the Alkaline type, which when connected in series, provide a terminal voltage of approximately 4.5 volts fully charged. The batteries preferably provide the power to the low voltage electronic circuits directly through electronic series regulators. The relative high voltage 15 volt power supply for the piezo audio alarm is derived from the batteries preferably by means of a DC/DC convertor which is only activated when the alarm is operating. At all other times it is preferably deactivated to conserve battery power.

Container 100 may be constructed from a variety of materials. For example only, the body of container 100 may be made of high impact resistant plastic (ABS, PC or other similar materials) or metal and is preferably relatively light weight. The container may be formed from a flexible material such as a cloth or soft sleeve if desired. A cloth material is more light-weight than many other materials. The cloth material may include one or more fibres of a material more resistant to breakage than the cloth to permit the cloth sleeve to be substantially tamper-proof when attacked by a sharp object such as a knife. For example, the cloth may include one or more ceramic or metal fibres interwoven into fabric.

Having described the preferred components of the security container, a preferred method of use will now be described with reference to FIGS. 1 to 3.

To initialize the rotation detection system, preferably a user security code is entered. Once the security code has been accepted, preferably the same four to six digit numeric sequence may be used to arm or disarm the system. To initialize the system, the user preferably presses and holds the arm and disarm keys at the same time until the monitor light turns on. The old code is entered and then the user presses the disarm key. The system will beep once and the monitor light will start flashing. The new 4 to 6 digit code is entered and the user presses the arm key. The system will beep twice. The user enters the new 4 to 6 digit code again and presses the arm key. The system will beep twice and the monitor light will stop flashing. This indicates that the new code has been saved into memory.

If the system beeps one long beep and the monitor light stops flashing, it means an entry error has been detected and the complete security code sequence needs to be started again by releasing and then pressing and holding the arm and disarm keys down at the same time to begin another security code initialisation sequence.

The user can reset the security code at any time the system is disarmed by holding the arm and disarm keys down at the same time and then repeating the initialization procedure. Once the security code has been entered and accepted the system can be armed and disarmed as required by the user.

To arm the system, the user preferably presses the arm key followed by the security code's four to six digit numeric sequence and then presses the arm key a second time to complete the arm function. As soon as the arm key is pressed, the microcontroller changes from sleep mode to monitor mode and monitors keypad 132 for the entry of the arm sequence. If an incorrect security code is entered or the user takes longer than the guard time to enter the arm sequence, a long beep is given and the arm function is terminated. At any time before the arm key is pressed a second time, the arm sequence can be terminated by pressing the disarm key. The system will respond with a long beep indicating it has recognized the termination of the arm sequence. Alternatively, if the arm sequence is discontinued, the microcontroller will preferably automatically terminate the arm sequence when the guard time expires.

When the arm key is pressed to initiate an arm sequence, the LED indicator is illuminated and remains on for the duration of the arm sequence.

If the arm sequence is accepted, the system gives two short beeps indicating the transition delay has commenced, which allows the user to position container 100 before monitoring begins. The system LED gives a short flash for each second of the transition delay. When the transition delay expires, the system gives another two short beeps before becoming armed, the LED indicator is turned off and the system enters its monitor mode.

Once the system is armed, it enters a monitor mode and preferably any movement which causes an angular rotation around one or more axis (pitch, roll or yaw) is deemed to be a hostile event capable of activating alarm 126. If the system is already armed and a user starts to enter the arm sequence again, the system is preferably programmed to recognize this and suspend activation of the alarm pending a correct arming sequence being entered. If the correct arming sequence is entered, the system waits for a predetermined period of time before re-arming. However, if the arming sequence is entered incorrectly, this is immediately deemed to be a hostile event. The system goes to an alarm mode and audible alarm 126 is activated.

Once system 106 has been armed, it changes from sleep mode to monitor mode where it is preferably continually checking to see if it has been rotated or moved from the initial reference point.

If lid 102 is positioned so that keypad 132 can be operated without moving container 100, the disarm sequence is similar to the arm sequence. In this situation, the user preferably presses the disarm key followed by the security code's four to six numeric sequence and then presses the disarm key a second time to complete the disarm function. If the disarm sequence is entered correctly, two short beeps are given after the disarm key is pressed the second time to complete the disarm sequence entry. The system then preferably reverts to sleep mode where the microcontroller powers the system down to its minimum operating power condition.

If the disarm sequence is not correct or takes longer than the guard time to enter, the system changes from monitor mode to a tamper mode. The disarming procedure required once the system is in tamper mode depends on which operating mode has been set by the user. Preferably the invention can be set to one of three operating modes which determine the latitude available to disarm system 106 once the system changes to tamper mode.

In a preferred embodiment of the invention there are at least three operating modes which are:

Instant Mode

As soon as system 106 determines it has moved and/or has been rotated, the alarm condition is activated.

Delayed Mode

System 106 uses the same angular rotation criterion as instant mode except the alarm condition is delayed by 5 seconds. If the disarm key is pressed during the 5 second delay period the system reverts to the disarm sequence. If the disarm key is not pressed during the 5 second delay period, the alarm condition is activated.

Timed Mode

System 106 uses the same angular rotation criteria as instant mode except the alarm condition and rotation monitoring are suspended for 3 seconds. After the 3 second interval from the time angular rotation was first determined, the system's gyroscope outputs are again tested with the instant mode criteria and if it is being moved (rotated) the alarm condition is activated. If the system is not being rotated, normal monitoring is resumed.

To prevent repeated attempts to disarm the system from occurring when the system is in monitor mode, controller 124 preferably automatically interprets a keypad entry as a potential hostile event. If the first number entered is correct, the microcontroller reverts to the normal disarm mode. If the first number or any subsequent numbers entered are incorrect, instead of entering the alarm mode as for disarming after a hostile event, the system waits for a) the guard time to expire or b) the maximum number of numbers to be entered or c) the disarm key to be pressed at which time a hostile event is determined and the alarm 126 is activated. The incorrect entry of the disarm sequence once a keypad entry commences is preferably a sufficient condition to cause a hostile event even though the system rotation limits have not been reached.

When system 106 determines that container 100 has moved by being rotated, the system preferably registers the occurrence of a hostile event. However, the hostile event could be the result of the user moving the container in order to disarm it in the normal method of use. By providing preferably three operating modes, the user is able to select one of these modes which best suits their usage pattern.

Once system 106 is in alarm mode, preferably the only way to disarm the system and cancel the alarm is to enter the disarm code sequence within a predetermined time. The number of attempts to enter the disarm code is not limited, however once the alarm condition is activated, alarm 126 will continue until the correct disarm code is entered or rotation ceases.

If the alarm is cancelled with the correct disarm code, system 106 may be programmed to revert to a system idle mode. If the alarm is cancelled because another optional preset condition has been satisfied, the system will preferably revert to the arm mode.

System 106 preferably only changes to alarm mode if a hostile event is deemed to have occurred. As soon as the system enters alarm mode, it activates audible alarm 126 to alert the user and/or others that the container is being tampered with, or that the container has been rotated from the initial reference point. Movement caused by an accidental bump or knock to the system is preferably normally not deemed to be a hostile event because the movement is of very short duration and, in most cases, will be determined as not being a hostile event.

Once system 106 is in alarm mode, it will preferably continue to activate audible alarm 126 until the correct disarm sequence is entered, movement ceases or some other optional preset condition is satisfied.

System 106 is preferably able to accurately measure its own rotation relative to the initial reference. Once system 106 is in the alarm mode, its angular rotation measuring capability in three dimensions preferably allows the system to discriminate between different hostile events and take the appropriate action relative to each event. Examples of such events include, but are not limited to: (1) the container is moving; the alarm remains active as long as the container is being moved; and/or (2) the container has stopped moving; the alarm remains active for 10 seconds after the movement ceases.

If container 100 remains stationary, the three signal outputs of the gyroscope will show the system is at its Zero Rate condition. A force needs to be applied to the container to cause it to rotate. As soon as this occurs, the gyroscope signals will change from the Zero Rate level and the microcontroller of controller 124 will determine that rotation of the container is occurring.

To discriminate between accidental movements or bumps and movements which are due to a hostile event, the duration that the rotation of the container exceeds the threshold value may be used as a second and necessary condition to determine a hostile event has occurred. In this case an accidental bump of the container will cause rotation on one or more of the X-axis, Y-axis or Z-axis which exceeds the threshold value for a hostile event. The controller algorithms may discriminate such an event is due to an impulse occurrence such as a bump or knock, and allow false alarm conditions to be minimized.

It will be appreciated that certain of the steps described above may be performed in a different order, varied, or omitted entirely without departing from the scope of the present invention.

A BRIEF DESCRIPTION OF THE OPERATION OF A PREFERRED EMBODIMENT OF THE INVENTION

Preferably the system will remain stationary in the same position and orientation at the time the system is armed. If the system is subjected to a change in pitch and/or roll and/or yaw, these constitute necessary and sufficient changes for a hostile situation to be determined. If the system's angular rotation is being measured at regular intervals, it is only necessary to determine if the system's movement has changed from one successive sample to the next to be able to determine whether the system's rotation and/or orientation has changed.

The preferred angular rotation measurement parameters are set forth below.

- The basic system timing is generated by the real time clock (RTC) which generates an interrupt to the microcontroller 16 times per second or once every 62.5 msec.
- The RTC interrupt causes the microcontroller to change from its Power Down mode to its Operating Mode.
- The microcontroller counts the interrupts it receives from the RTC and every 500 msec or twice a second it measures the instantaneous acceleration values of the X, Y and Z-axis of the accelerometer. This is called the basic sample rate or BSR.

Because the MEMS gyroscope is a mechanical/electronic device, there is a certain very low level of random background noise which should be removed to ensure the resultant measurement is accurate. One method of removing the background noise is to use an electronic low pass filter in the signal path between the gyroscope and the microcontroller. However this method also requires the time between successive samples to be extended.

In this preferred embodiment of the system, a mathematical algorithm called a rolling averaging filter is preferably used by the microcontroller to remove the gyroscope background noise.

- The rolling averaging filter sample period is preferably 100 msec commencing every BSR time.
- The number of X, Y and Z-axis samples taken during the 100 msec rolling averaging filter sample period is preferably 64, which are evenly spaced at 1.5625 msec intervals.

The accuracy of the measurements of the instantaneous values of the X, Y and Z-axes angular rotation of the gyroscope, and the basic accuracy of the MEMS gyroscope itself preferably determine if the system is able to meet its criteria of being able to determine if it is being rotated. It may be that an individual with an understanding of how a device such as the present invention is constructed could try to thwart its operation by moving the system in such a manner that the system's accuracy is compromised. However, the measurement techniques and algorithms incorporated in the system and described below provide a level of accuracy which exceeds the ability of most, if not all humans to move the system without creating a hostile event.

The preferred operating parameters are set forth below.

- All angular rotation measurements are relative to previous measurements so absolute position samples and initial condition zeroing or nulling is not required.
- Determinations of angular rotation are preferred and complete the alarm conditions. It is not necessary to calculate the acceleration, angle of tilt, or the velocity and/or distance of movement of the system in this preferred embodiment.
- The change in the analog output signal of any of the gyroscope X, Y or Z-axis outputs is preferably only caused by the system physically being rotated about one or more of its axes.

Any change in the system's angular rotation being measured by the gyroscope is a valid indication that the system is moving from its previous stationary position. This preferred embodiment of the invention preferably has three operating modes as set forth below.

Instant Mode

- As soon as the system is determined to have moved and/or rotated, the alarm condition is activated.

Delayed Mode

- The same angular rotation criterion as instant mode except the alarm condition is preferably delayed by 5 seconds. If the disarm key is pressed during the 5 second delay period, the system reverts to the disarm sequence. If the disarm key is not pressed during the 5 second delay period, the alarm condition is activated.

Timed Mode

- The same angular rotation criteria as instant mode except the alarm condition and rotation monitoring are preferably suspended for 3 seconds. After a 3 second interval from the time angular rotation was first determined, the system's gyroscope is preferably tested with the instant mode criteria and if it is being moved (rotated) the alarm condition is activated. If the system is not being rotated, normal monitoring is resumed.

The system preferably uses a rolling average filter algorithm that is a subroutine which is called without input parameters. The rolling average filter algorithm preferably returns three 10 bit readings which are the rolling average filter values of the gyroscope's X, Y and ZZ-axis average of 64 instantaneous samples taken over a 100 msec period.

The preferred angular rotation algorithms used in this preferred embodiment of the invention are set forth below.

- Two 16-bit register sets of three registers each are maintained. They are called RVx, RVy and RVz for rotation sample value from the gyroscope's X axis, Y axis and Z-axis.

The rolling average filter algorithm:

a. returns the values of the current gyroscope's X, Y and Z-axis samples in registers RVx0, RVy0 and RVz0, b. returns the results of the previous gyroscope's X, Y and Z-axis samples in registers RVx1, RVy1 and RVz1, c. returns the sum of the deviations of RVx0 and RVx1, RVy0 and RVy1 and RVz0 and RVz1 in RVΔ.

When the system is armed, the user preferably has 10 seconds to place it in the required position before angular rotation monitoring commences.

To initialize the system before monitoring commences, the rolling average sample filter algorithm is preferably called to set up the initial acceleration values.

The 500 msec sample time is preferably established from the RTC then the filter algorithm is called. The rotation values in RVx0, RVy0 and RVz0 are preferably moved to RVx1, RVy1 and RVz1 by the filter algorithm.

The rolling averaged samples of the X, Y and Z-axis rotation values are preferably stored in RVx0, RVy0 and RVz0.

The absolute deviation between the current samples and the previous samples are preferably divided by 2 to remove any remaining noise perturbations and are then stored in registers RVxΔ, RVyΔ and RVzΔ. The summation of the deviations is preferably stored in RVΔ0.

The filter algorithm preferably returns to the rotation monitoring routine where the results are analyzed to determine if the system is being subjected to movement and/or tilt and the appropriate action is then taken.

Many of the current aspects of the invention may be powered by readily available batteries, preferably three of the AAA Alkaline type, although other primary or rechargeable batteries can be used. To maximise the battery life, and thus the length of time the invention can be used before the batteries have to be replaced, a power management algorithm is preferably built into the microcontroller's firmware which minimises power usage relative to the functional state of the system.

Three AAA Alkaline batteries, when connected in series, typically provide a voltage of 4.5 volts and a capacity of approximately 1250 mAhours (mAh). By suitable arrangements of the power supply and operating the electronic subsystems at a voltage of 3.0 volts, the full capacity of 3×AAA Alkaline batteries is available to operate the electronics system of the invention. This capacity excludes the alarm system, which has its own power requirements, but is only activated by a hostile event. In that instance, gaining attention is the prime requirement and not power conservation. Because of this, the alarm system power requirements are not considered in the battery power management algorithms.

When the controller is in its Power Down state, where it is not armed and all of the electronics subsystems are switched off, the battery current drain is approximately 1 uA. With fresh batteries, this provides a standby time of approximately 1,250,000 hours or 146 years. Clearly this exceeds the physical life of a battery, so if the system is not being used, the available capacity will be limited to the batteries "shelf life."

The electronic system preferably includes a number of sub-systems which can be powered On or Off under the control of the microcontroller. Not all of the electronic subsystems need to be active all of the time depending on the tasks required at any one time.

To extend the battery life, when the system is armed, a very low power real time clock may be used as the basic timing circuit. The controller's microcontroller can power itself down to a state where the battery power consumption is less than 1 uA. However, in this state it requires an external signal to force it to activate into an operational state. Pressing a key on the keypad provides this stimulus and allows the microcontroller to monitor and process user key entries.

The other stimulus is a very low power real time clock which can be activated by the microcontroller when it enters the Armed State. The real time clock is preferably a crystal controlled time base which generates a stimulus or interrupt to the microcontroller. In the Armed State, and before the microcontroller powers down to its very low Power Down State, it preferably disconnects the power from all of the other electronic sub-systems except for the real time clock. When the microcontroller enters the Power Down State, the system's battery requirements reduce to approximately 2 uA.

As noted before, the real time clock preferably generates an interrupt to the microcontroller multiple times each second. The interrupt brings the microcontroller out of the Power Down State to an active Armed State, and the X, Y and Z-axis rotation values from the gyroscope are measured to determine if the system has moved and if a hostile event has occurred.

As soon as the microcontroller powers up after receiving a real time clock interrupt, it applies power to the gyroscope, which increases the battery current to the maximum operating level. The gyroscope preferably requires a short period of time to stabilise after power is applied and during this time the microcontroller suspends itself to a reduced power mode. Once the gyroscope stabilization period ends, the microcontroller powers up to full operational mode, takes the current X, Y and Z-axis rotation readings and calculates the current angular rotation status of the system. If a hostile event has not occurred, the microcontroller disconnects power to the gyroscope and powers down to its Power Down State until the next real time clock interrupt causes the cycle to be repeated. The operational life of the batteries when the system is armed is increased significantly by the use of the power management methods incorporated in the preferred current embodiments of the system.

In a preferred embodiment of the system, the particular electronic circuits used to form the system require amounts of battery power that may be different if different electronic circuits are used in other embodiments to achieve the same or similar power management functionality.

The foregoing description is by way of example only, and may be varied considerably without departing from the scope of the present invention. For example only, the size, shape, colour, weight and material of the container may be varied as desired. For example, the container may have a storage capacity ranging from zero to that of a standard cargo container (or more). The shape may be configured specifically for hand-carried items such as laptop computers, mobile phones and MP3 players, and even traditionally non-electrical items such as handguns. When formed for use with a laptop computer, the container and/or system may be sized and configured for substantially enveloping the laptop or may be of reduced size and configuration so as to cover only a portion of the exterior of the laptop. If formed as a container, the container may have a width in the range of approximately 10 to 25 cm, a length in the range of approximately 20 to 35 cm, and a height in the range of approximately 2 to 12 cm. These dimensions are exemplary only and may be modified to accommodate an object or item for which protection is sought. The system may be incorporated into the laptop, a mobile phone or other device if desired. The container may be water-proof if desired (in which case one or more LEDs may be used to provide a visual alarm).

Elements of the angular rotation detection system may be varied. For example, the placement, number, and type of alarms may be varied as desired. Examples of alarms include audio and/or visual and/or wireless to a monitoring base station. A variety of input means may be utilised. For example, the system may include a biometric reader, a magnetic reader such as a swipe card reader, manual push means such as alphanumeric keys or dials, voice activated arming, mechanical switches, mechanical lock and key, radio control, RDFI or any combination thereof.

The power supply may be self-contained and/or derived from an outside source. For example, the power supply may be battery powered with disposable or rechargeable batteries, or utilise another onboard source such as one or more solar panels. Any onboard power supply may be supplemented or replaced by an external source accessible via a power connection (e.g., a cable connection between the container and a wall outlet).

The angular rotation detection system may be configured to measure rotation in only one plane if desired. For example, the system may be configured to measure in only the horizontal plane, or only the vertical plane, or a diagonal plane. The angular rotation detection system may be used to lock the container in addition to or in place of a manual lock between portions of the container. For example, the keypad may be used to insert a combination to release a lock between the lid and base. The system may include one or more global positioning system (GPS) elements in place of or in addition to the gyroscope. One or more components of the system may be remotely located or controlled if desired. For example, the alarm may be separately portable and carried, for example, as a key ring with the user or report to a remote location. One or more elements of the angular rotation detection system may be integral with the object which it is desired to protect. For example, products such as car alarms, laptop computers and cell phones may include the angular rotation detection system such as described above as an integral component of their structure. This may involve, for example, configuring the computer electronics of the product to function as described above. The gyroscope described above may be used in combination with an accelerometer and/or a compass (two or three-axis) if desired. The microcontroller may be programmed for sensor fusion to activate the alarm when the combined data from the gyroscope, accelerometer and/or compass exceed a predetermined threshold, such as set forth above. The system may include a Kalman filter to reduce noise if desired.

The features described with respect to one embodiment may be applied to other embodiments, or combined with or interchanged with the features other embodiments, as appropriate, without departing from the scope of the present invention.

The present invention in a preferred form provides many advantages. For example only, the dual security of a lock and angular rotation measuring alarm system provides a high level of security against theft of the valuables protected by the rotation detection system. The present invention in a preferred embodiment may discriminate against different types of movement in three dimensional space. The present invention in a preferred embodiment may be adapted to operate in any physical orientation equally well and provide the same level of sensitivity to the measurement of rotation of itself in all orientations. The present invention in a preferred embodiment may be adapted to discriminate between motion caused by accidentally bumping and and/or rotation caused by the container moving beyond a predetermined limit. The present invention in a preferred embodiment is not required to be in a predetermined orientation.

The present invention has many applications. For example only, elements of the container and/or system may be used for portable security items such as cargo containers, vehicles such as cars, bicycles, motorcycles, and in environments such as hospitals, schools, prisons, sporting venues, and recreational areas such as beaches and parks. The container and/or system may be sized and configured for use with a handgun if desired. If used with a handgun, the system may be incorporated with a handgun lock, for example, around the trigger area. The container and/or system may be attached to or incorporated into suitcases, backpacks or other luggage carrying products if desired. As will be appreciated, many other applications are available.

It will of course be realised that the above has been given only by way of illustrative example of the invention and that all such modifications and variations thereto as would be apparent to persons skilled in the art are deemed to fall within the broad scope and ambit of the invention as herein set forth.

What is claimed is:

1. A mobile personal alarm system for monitoring a hand-carried object having an X-axis, a Y-axis and a Z-axis, comprising:

a MEMS gyroscope adapted to detect angular rotation of the object around at least one of the X, Y and Z-axes;

a controller operable to determine a change in the angular rotation of the object around at least one of the X, Y and Z-axes based on the detection of the angular rotation by said MEMS gyroscope, said controller being operable to make multiple measurements of changes in the angular rotation of the object, each subsequent measurement being compared to a previous measurement to determine the change in the angular rotation of the object, said controller being operable in a first mode to activate said alarm after the change in angular rotation of said object has been determined, said controller being operable in a second mode to delay transmitting the signal with said alarm for a predetermined period of time, said controller being operable in a third mode to suspend determining change in angular rotation for a predetermined period of time; and an alarm adapted to transmit a signal upon the change in the angular rotation of the object as determined by said controller, said controller activating said alarm when the change determined by said controller exceeds a predetermined threshold.

2. The system of claim 1, wherein said controller is operable to determine a magnitude of an angular rotation change around any of its X and/or Y and/or Z-axis.

3. The system of claim 1, further comprising an electronic low pass filter to reduce background noise between said MEMS gyroscope and said controller.

4. The system of claim 1, further comprising a rolling average filter to reduce background noise between said gyroscope and said controller.

5. The system of claim 1, further comprising an accelerometer.

6. The system of claim 5, wherein said controller includes a microcontroller programmed for sensor fusion to activate said alarm when combined data from said MEMS gyroscope and accelerometer exceed a predetermined threshold.

7. A container, comprising:

a body having a storage compartment dimensioned to store a hand-carried object, said body having a lid with a top cover and a base cover; and an angular rotation detection system having a MEMS gyroscope, a controller operable to determine a change in angular rotation of said body from a reference point based on a stationary position of said body, and an alarm adapted to transmit a signal when said controller has determined a change in the angular rotation of said body, said angular rotation detection system being positioned at least in part between said top cover and said base cover of said lid, said controller being operable in a first mode to activate said alarm after the change in angular rotation of said body has been determined, said controller being operable in a second mode to delay transmitting a signal with said alarm for a predetermined period of time, said controller being operable in a third mode to suspend determining change in angular rotation for a predetermined period of time.

8. The container of claim 7, wherein said controller is operable to determine a change in magnitude of the angular rotation of the said body.

9. The container of claim 7, further comprising an electronic low pass filter to reduce background noise between said gyroscope and said controller.

10. The container of claim 7, further comprising a rolling average filter to reduce background noise between said MEMS gyroscope and said controller.

11. The container of claim 7, wherein said controller is operable to activate said alarm when the change determined by said controller exceeds a pre-determined threshold.

12. The container of claim 7, wherein said body has a length in the range of approximately 20 to 35 cm, a width in the range of approximately 10 to 25 cm, and a height in the range of approximately 2 to 12 cm.

13. A method for alerting a person to movement of a hand-carried object from a reference position, comprising:

measuring an angular rotation of the object due to movement of the hand-carried object to determine a first measurement;

re-measuring the angular rotation of the object due to movement of the hand-carried object after a pre-selected time interval to determine at least a second measurement, the second measurement being made relative to the first measurement;

comparing the first and second measurements; and producing an alarm signal if the first and second measurements are different; and selecting an operating mode from among at least first, second and third operating modes, the first operating mode activating the alarm if the first and second measurements are different, the second mode delaying transmitting the alarm signal for a predetermined period of time, the third operating mode suspending the measuring of angular rotation of the object for a predetermined period of time.

14. The method of claim 13, wherein the producing of the signal includes producing the signal upon detection of an angular rotational change of the object.

15. The method of claim 13, wherein the producing of the signal includes producing the signal upon detection of a change in magnitude of the angular rotational change of the object.

16. The method of claim 13, further comprising utilizing an electronic low pass filter to decrease background noise.

17. The method of claim 13, further comprising utilizing a rolling average filter to decrease background noise.

18. The method of claim 13, further comprising measuring acceleration of the object with an accelerometer.

19. The method of claim 13, further comprising storing the object in a container, the alarm signal being produced from within the container.

20. The method of claim 13, further comprising at least one of:

measuring a position of the object relative to the Earth's magnetic field with a magnetometer; and measuring a direction of the object with a compass.

21. A mobile personal safe, said safe comprising:

a base forming a storage compartment configured to store a hand-carried personal item;

a lid configured to close said storage compartment;

an angular rotation detection system having a MEMS gyroscope, a microcontroller operable to determine a change in angular rotation of said base from a reference point based on a stationary position of said base, and an alarm adapted to transmit an audible signal of at least 80 dB outside said safe when said microcontroller has determined a change in the angular rotation of said base, said microcontroller activating said alarm when the change determined by said microcontroller exceeds a pre-programmed threshold;

a lock integral with at least one of said base and said lid for locking said lid in a closed position relative to said base;

an accelerometer for determining tilt; and a compass, said microcontroller being programmed for sensor fusion to activate said alarm when combined data from said MEMS gyroscope, accelerometer and compass exceed a predetermined threshold.

* * * * *